United States Patent [19]

Strom

[11] 4,450,936

[45] May 29, 1984

[54] REMOVABLE STEP FOR PALLET RACK

[75] Inventor: Hubert Strom, Ft. Worth, Tex.

[73] Assignee: Interlake, Inc., Oak Brook, Ill.

[21] Appl. No.: 495,764

[22] Filed: May 18, 1983

[51] Int. Cl.[3] ..... E06C 7/08; E06C 9/04

[52] U.S. Cl. ..... 182/92; 248/221.2

[58] Field of Search ..... 182/92, 100, 189; 248/221.2, 220.3, 220.4; 280/163

[56] References Cited

U.S. PATENT DOCUMENTS

| | | | |
|---|---|---|---|
| 3,259,209 | 7/1966 | Brown | 182/92 |
| 3,357,719 | 12/1967 | McCrea | 182/92 |
| 3,399,746 | 9/1968 | Wood | 182/92 |
| 3,712,418 | 1/1973 | Currence | 182/92 |
| 3,813,070 | 5/1974 | Hanson | 248/221.2 |
| 3,833,090 | 9/1974 | Georgianna | 182/92 |
| 3,902,568 | 9/1975 | Erickson | 182/92 |

*Primary Examiner*—R. P. Machado

*Attorney, Agent, or Firm*—Allegretti, Newitt, Witcoff & McAndrews, Ltd.

[57] ABSTRACT

A removable step for climbing a storage rack which supports pallets in a warehouse or the like. The step comprises a U-shaped rod, the free ends or legs of which are bent at a right angle to the closed portion of the U, which portion provides a step. The legs fit into a first pair of openings in the face of a column comprising part of the rack. The column has many pairs of openings spaced along its length. The legs terminate in hooks which hook over a second pair of openings below said first pair to keep the step from tilting under the load of the climber's foot.

11 Claims, 7 Drawing Figures

REMOVABLE STEP FOR PALLET RACK

This invention relates to a removable step adapted to be placed at varying heights in the column of a support structure, such as a shelf structure for supporting palletized loads. p In working in storage areas equipped with pallet racks, it is often desirable for a workman to be able to climb up on the suoport structure to have access to a pallet or shelf mounted on the structure. A ladder may be used for this purpose, or the workman can step on the elevated fork of a lift truck. Either of these means of access is cumbersome and requires moving equipment which may not be right at hand.

The object of this invention is to provide a step that is small enough to be carried by a workman in his pocket and inserted in any perforated upright member of the support structure at any convenient height. If desired, removable steps can be used in pairs, inserting one above the one the workman is standing on, stepping on the upper one with the other foot, removing the lower one and repeating the procedure. Thus, the upright member can be scaled to any desired height using two of the removable steps of the invention.

Another object is to provide a removable step which swings into the interior of a box-section upright to permit retracting it out of the way when not in use.

Still another object is to provide a step which may be readily inserted into, or withdrawn from, a support column through openings in a face of the column.

These and other objects and advantages of the invention will become apparent from the following description when read in connection with the accompanying drawings, in which FIG. 1 is a perspective view of a box-section upright member having a removable step constructed in accordance with the invention mounted therein.

Figure 1:
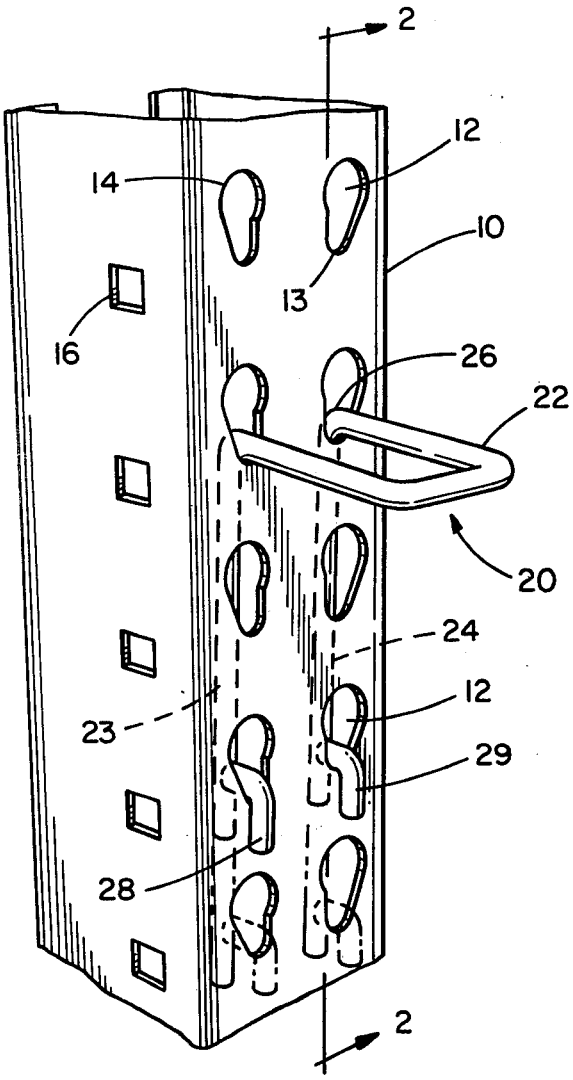

Referring to FIG. 1, the upright member 10 comprises a part of a pallet rack of the type illustrated in McConnell, U.S. Pat. No. 3,303,937. These racks are commonly used in warehouses to support palletized loads or shelves. Member 10 is box-shaped in cross-section, having a longitudinal opening along the rear side thereof to receive cross members (not shown) comprising part of the rack. The front face of the member 10 has pairs of openings 12,14 which are generally keyhole shaped and terminate in a narrower portion 13 at the bottom. The upright member may also contain openings 16 in an adjacent wall which have no relevance to the invention.

The removable step 20 is made from a U-shaped piece of rod stock having two legs 23,24. The U-shaped rod is bent as indicated at 26 to form a step or support portion 22 extending at right angles to the pair of legs 23,24. The legs 23,24 terminate at their lower ends in hooks 28,29 which are adapted to hook over the lower portions 13 of the openings through the face of the upright member 10. The hooks are formed by welding inverted L-shaped pieces of the same rod stock to the legs. The weld is indicated at 27 in FIG. 2.

Figure 5:
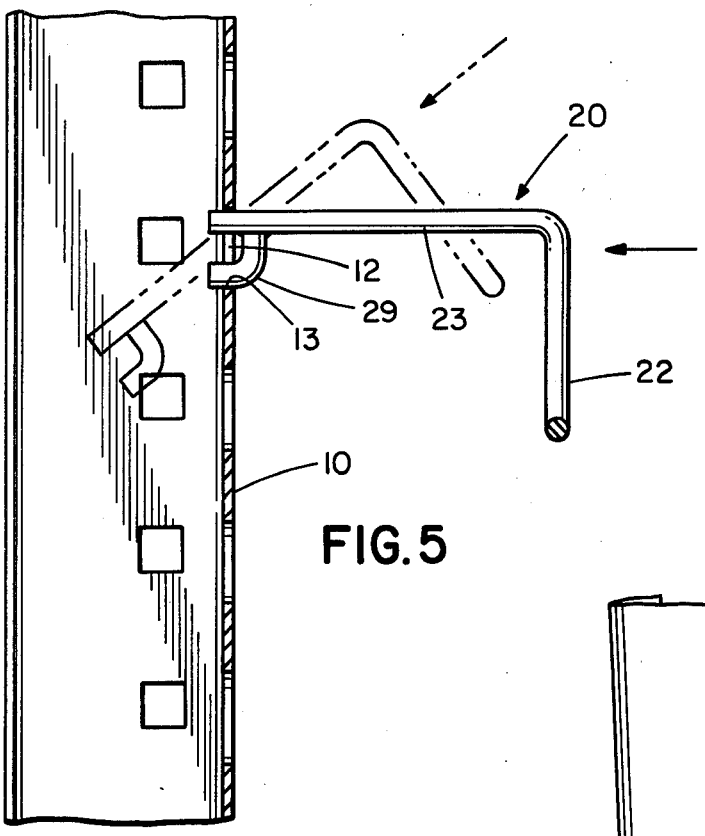
FIG. 5 is a view similar to FIG. 4 showing the step being removed from the upright member.
Figure 6:
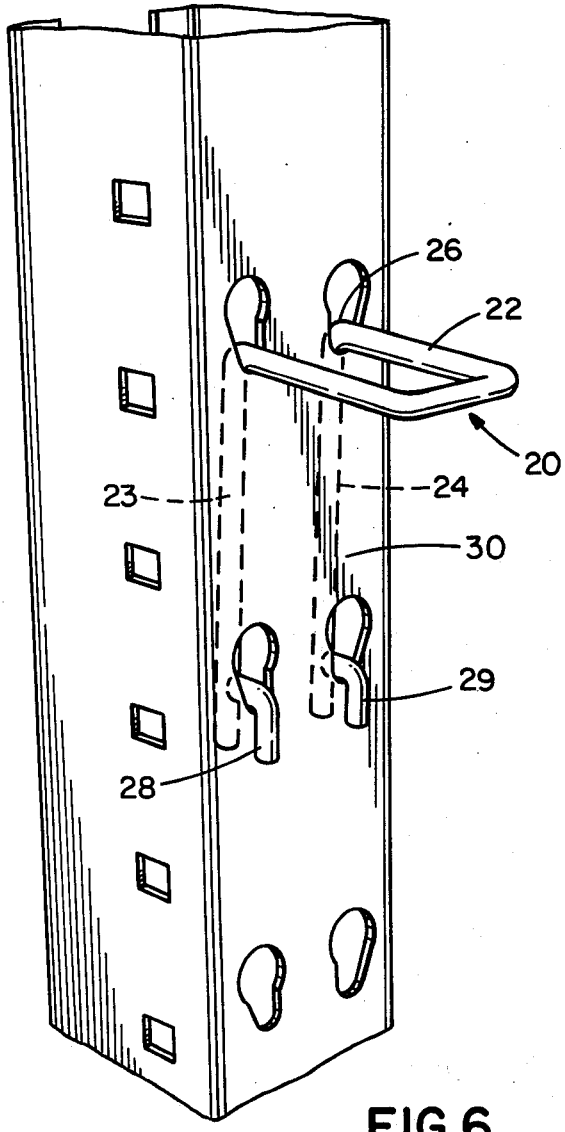
FIG. 6 is a view similar to FIG. 1 in which the removable step in shorter, corresponding in length to the vertical space between adjacent pairs of openings in the upright member.

It will be noted that the removable step shown in FIGS. 1 through 5 is equal in length to the distance between a first pair and a third pair of vertically spaced openings. This distance is not critical, however, and if desired, the step may correspond in length to the spaces between four sets of openings, as shown in phantom lines in FIG. 1. It is also possible to make the removable step smaller by reducing its length to the space between adjacent pairs of openings as illustrated in FIG. 6. Thus the length of the legs between the right angle bend and the hooks is equal to a multiple of the distance between adjacent pairs of openings.

Figure 2:
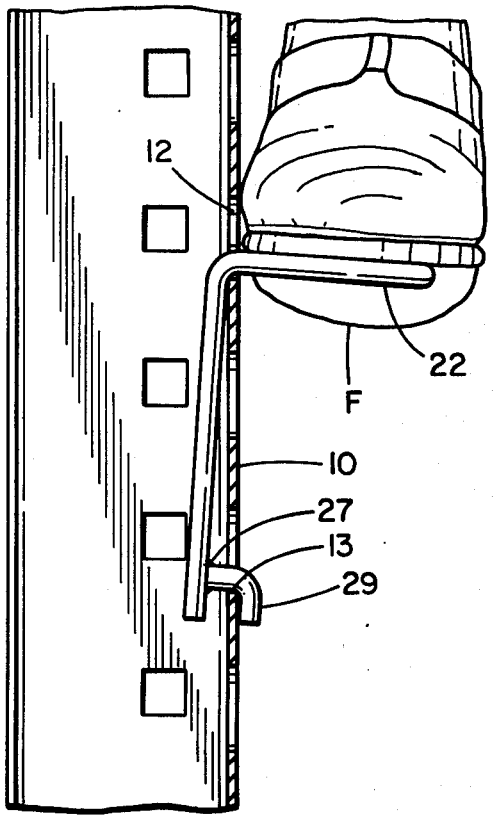
FIG. 2 is a sectional view through the assembly of FIG. 1 taken along the line 2—2 and showing a foot resting on the support portion of the removable step.
Figure 3:
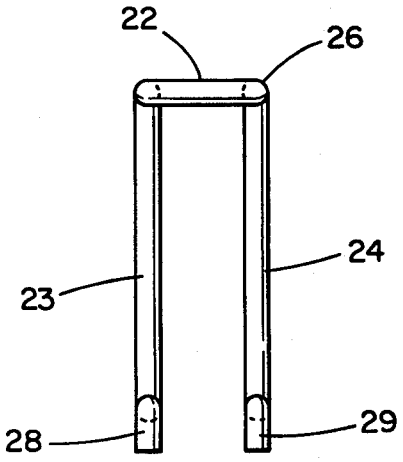
FIG. 3 is a front elevational view of the step 20 shown in FIGS. 1 and 2.

The support portion of the step 22 projects out beyond the face of the upright member 10 a sufficient distance to permit support of a man's foot, as shown at F in FIG. 2. The weight is taken equally by the curved portion of the upright 10 directly beneath the bends 26 and the curved portion of the upright directly beneath the hooks 28,29.

Figure 4:
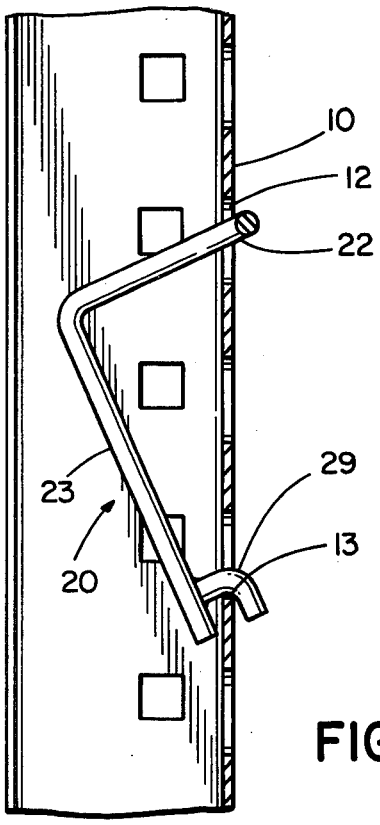
FIG. 4 is a view similar to FIG. 2 showing the step in retracted position inside the box-section of the upright member.

When the step is not in use, it may be retracted to the position shown in FIG. 4 by pivoting about the hooks 28,29. To remove the step from the upright member, the legs are pulled through the openings 12 as indicated in FIG. 5. The hooks are slightly smaller in depth than the height of the keyshaped openings 12 so that they move through the openings without difficulty. Preferably, the diameter of the rod stock from which the removable step is formed is slightly smaller than the diameter of the rounded bottom 13 of the keyhole 12. Thus, the weight on the step is distributed over the lower curve of the bottom of the keyhole 12.

Figure 7:
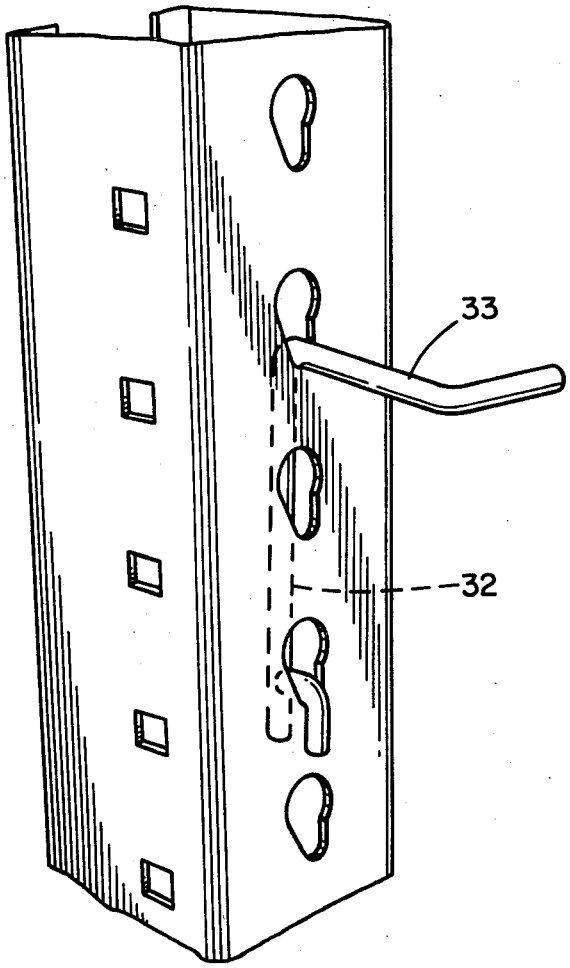
FIG. 7 is a view similar to FIG. 1 showing another form of the removable step which is adapted to fit into an upright member having a single row of openings rather than a double row.

FIG. 7 illustrates further modification of the invention which is suitable for use where the box-section upright member has a single row of holes. In this case, the removable step 32 has a single rod support portion 33 and constitutes just half of the step 20. It is not as stable as the step having two legs because it can rotate to a certain extent about the axis of its single leg. In all other respects, however, it corresponds in structure to the step 20.

The tread surface of the support portion 22,33 of the step may be serrated to provide a non-slip surface. The notches or teeth forming the serrations can be made in any manner well-known to those skilled in the art.

It will be appreciated that the removable step of the invention is small, light in weight, and can be easily transported in one's pocket so that it is always available for mounting a rack structure.

I claim:

1. In combination, a rigid, hollow, upright frame member and a removable step mounted on said frame member, said frame member having a box-like cross-section, pairs of horizontally spaced openings vertically disposed in a wall of said frame member, each said pair being regularly spaced an equal distance from the pair above and the pair below, said removable step comprising a U-shaped rod, the closed end of which is bent at right angles to the plane of the U to form a support portion, the distance between the legs of the U being equal to the distance between said horizontally spaced openings, the legs of the U terminating in hooks, the length of said legs between said right angle bend and said hooks being equal to a multiple of the distance between adjacent pairs of openings, said step being mounted with the legs inside the frame member, with said support portion projecting outwardly from one pair of openings and said hooks being hooked over a second pair of openings below said one pair.

2. The combination of claim 1 in which said hooks are shaped like claws.

3. The combination of claim 1 in which the frame member are generally keyhole-shaped and the diameter of said rod is slightly smaller than the lower narrow portion of the keyhole.

4. The combination of claim 1 in which said frame member is box-shaped in cross-section and said support is shorter than the width of the box so that said step can pivot about said hooks and retract into the frame member.

5. The combination of claim 1 in which said multiple is equal to two.

6. The combination of claim 3 in which the depth of the hook is less than the height of said keyhole-shaped opening so that said legs may pass freely through said openings.

7. A removable step to be mounted at varying elevations in a rigid, upright frame member, said member having pairs of horizontally shaped openings, each said pair being regularly spaced a predetermined, equal distance from the pair above and the pair below, said removable step comprising a U-shaped rod, the closed end of which is bent at right angles to the plane of the U to form a support portion, the distance between the legs of the U being equal to the distance between said horizontally spaced openings, the legs of the U terminating in hooks, the length of said legs between said right angle bend and the hooks being equal to a multiple of the distance between said adjacent pairs of openings whereby said step may be mounted on said frame member with said support portion projecting through one pair of openings and said hooks projecting through another pair of openings below said one pair.

8. The step of claim 6 in which each said hook consists of a curved length of rod welded to a leg, and which terminates at the same point as the leg.

9. An upright frame member comprising part of a pallet rack, said frame member having holes extending therethrough, said holes being spaced along the length of said frame member, and a step having at least one leg with a support portion extending at right angles thereto, said leg being dimensioned to pass through said holes, said leg terminating at the end opposite said support portion in hooks, said support portion extending outwardly through one of said openings and said hook extending through a second opening below said one opening when the step is mounted on the frame member.

10. The combination of claim 1 in which said support portion has a serrated tread surface.

11. The removable step of claim 7 in which said support portion has a serrated tread surface.

* * * * *